US011291909B2

(12) United States Patent
Gorden

(10) Patent No.: US 11,291,909 B2
(45) Date of Patent: Apr. 5, 2022

(54) SINGLE-FOOT SKATEBOARD

(71) Applicant: JMKRIDE International, LLC, San Diego, CA (US)

(72) Inventor: Jon Gorden, San Diego, CA (US)

(73) Assignee: JMKRIDE INTERNATIONAL, LLC, San Diego, CA (US)

( * ) Notice: Subject to any disclaimer, the term of this patent is extended or adjusted under 35 U.S.C. 154(b) by 0 days.

(21) Appl. No.: 16/785,476

(22) Filed: Feb. 7, 2020

(65) Prior Publication Data

US 2021/0245033 A1 Aug. 12, 2021

(51) Int. Cl.
*A63C 17/01* (2006.01)

(52) U.S. Cl.
CPC ..... *A63C 17/012* (2013.01); *A63C 17/014* (2013.01); *A63C 17/017* (2013.01)

(58) Field of Classification Search
CPC ..... A63C 17/01; A63C 17/011; A63C 17/012; A63C 17/014
See application file for complete search history.

(56) References Cited

U.S. PATENT DOCUMENTS

| | | | | |
|---|---|---|---|---|
| D610,643 | S * | 2/2010 | Chen | D21/764 |
| 9,919,200 | B2 * | 3/2018 | Mo | H02K 11/33 |
| 2005/0236783 | A1 * | 10/2005 | Reid | A63C 17/02 280/11.27 |
| 2006/0186617 | A1 * | 8/2006 | Farrelly | A63C 17/18 280/8 |
| 2007/0200305 | A1 * | 8/2007 | Hanson | A63C 17/02 280/11.28 |
| 2009/0174163 | A1 * | 7/2009 | Farrelly | A63C 17/06 280/87.041 |
| 2010/0090423 | A1 * | 4/2010 | Farrelly | A63C 17/06 280/11.27 |

* cited by examiner

*Primary Examiner* — Brian L Swenson
(74) *Attorney, Agent, or Firm* — Myers Andras LLP; Joseph C. Andras

(57) ABSTRACT

A Single-foot Skateboard. The Skateboard has interchangeable components in order to reduce spare part inventory. The footboard of the Skateboard is reversible.

9 Claims, 8 Drawing Sheets

SINGLE-FOOT SKATEBOARD

BACKGROUND OF THE INVENTION

1. Field of the Invention

This invention relates generally to personal transportation devices and, more specifically, to a Single-foot Skateboard.

2. Description of Related Art

Ferrelly, U.S. Pat. No. 8,308,171 describes a "Personal Transportation Device for Supporting a User's Foot Having Multiple Transportation Attachments" that was in many ways revolutionary for its time. The Ferrelly device is depicted in FIGS. 1, 2 and 3.

FIG. 1 is a perspective view of a user riding a pair of transportation devices 6 of the Ferrelly patent. The user 8 stands on the devices 10A, 10B so that his left foot 12A is positioned over the first device 10A, and his right foot 12B is positioned over the second device 10B. No straps are necessary, as the user's weight atop the devices 10A, 10B will retain them under the user's feet 12A, 12B. These devices 6 allow the user to create forward motion by kicking their feet back and forth in a repetitive motion. Numerous unique tricks have also been created using these devices 6. This early version of the Ferrelly device was ultimately replaced by the version depicted in FIG. 2.

FIG. 2 is a perspective view of a second embodiment of the Ferrelly transportation device—a skate for the user's left foot 110L. In comparison to the earlier version [6], this skate 110L has a single solid footboard 116L (i.e. for the left foot). The footboard 116L has a platform 114L upon which a non-skid textured layer 120 has been adhered.

The undercarriage 118L of the device 110L was streamlined and made more aesthetically pleasing in this embodiment. A pair of curved arms (124 shown here) extend in opposite directions and terminate in wheels 126 at their ends. FIG. 3 shows the bottom of device 110L.

As shown here, the undercarriage 118L is not in alignment with the footboard 116L—this is what allows the user to create forward motion by simple kicking motion. The longitudinal axis of the wheels A(w) is offset from the axis of the footboard A(f) by offset angle $+\alpha$.

As shown in FIG. 1, the user aligns each foot to be perpendicular to the footboard axis A(f). In order to create the desired propulsion, the left-foot device [10A] has a offset angle of $+\alpha$ (positive offset), whereas the right-foot device [10B] has an offset angle of $-\alpha$ (negative offset). One major problem with the Ferrelly device originates with the need for different offset angles for each foot. According to the Ferrelly approach, the footboard and undercarriage of the left skate cannot be used to assemble a skate for the right foot because the parts are not compatible. In order to assemble a left-foot skate [10A], you must use a left-side undercarriage 118L and a left-side footboard 116L. In order to assemble a right-foot skate [10B], you must use right-side versions of both of these parts.

Because of this, the user must discard and replace worn parts for both feet individually. Skateboard parts wear is a normal and regular part of this industry, but it would be a substantial benefit if a product were available that reduced the need for parts replacement as compared to the Ferrelly devices.

SUMMARY OF THE INVENTION

In light of the aforementioned problems associated with the prior devices, it is an object of the present invention to provide a Single-foot Skateboard. The Skateboard should have interchangeable components in order to reduce spare part inventory. The footboard of the Skateboard should be reversible.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Single-foot Skateboard.

Figure 1:
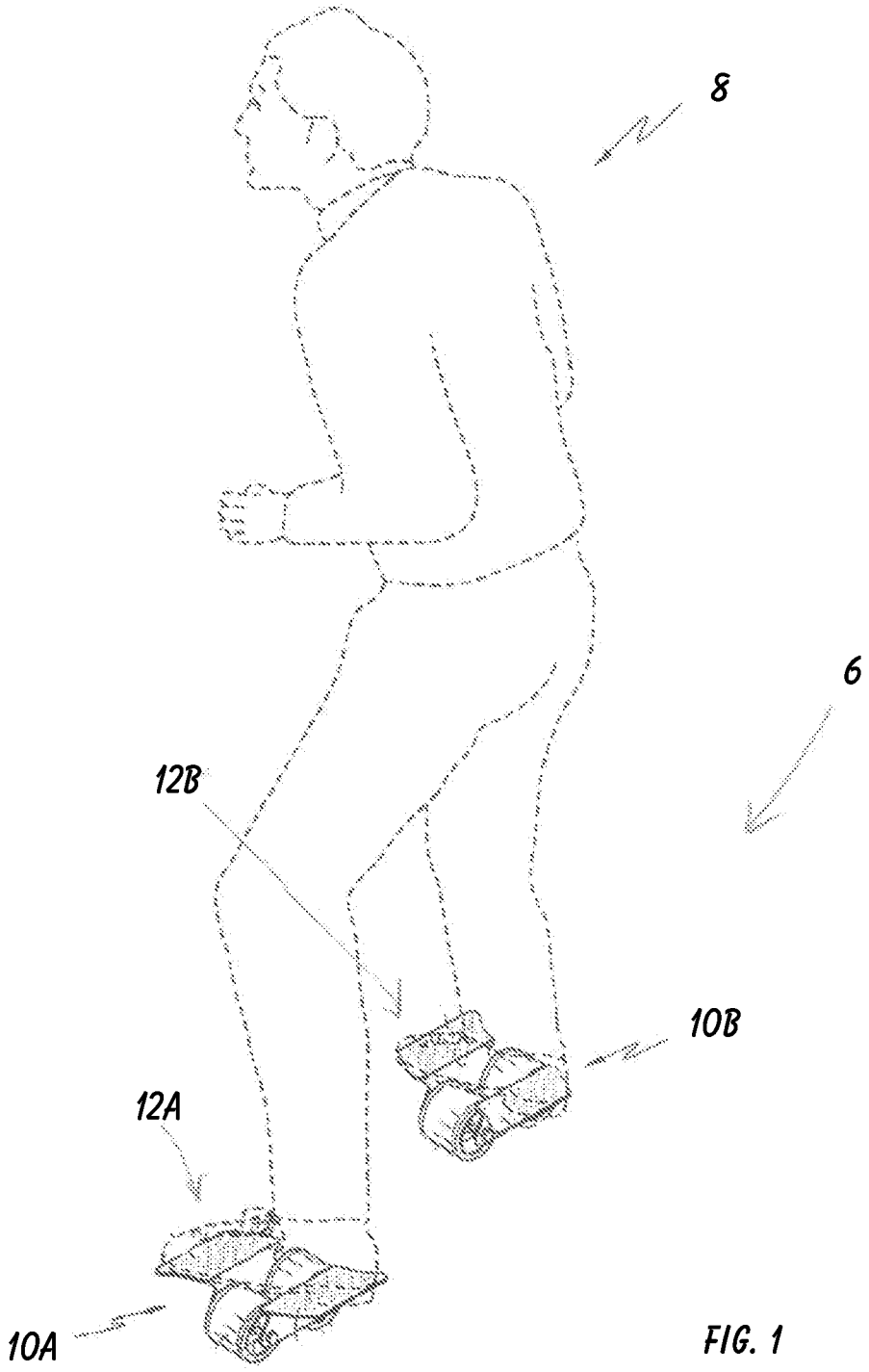
FIG. 1 PRIOR ART
FIG. 1 is a perspective view of a user riding a pair of transportation devices of the Ferrelly patent.
Figure 2:
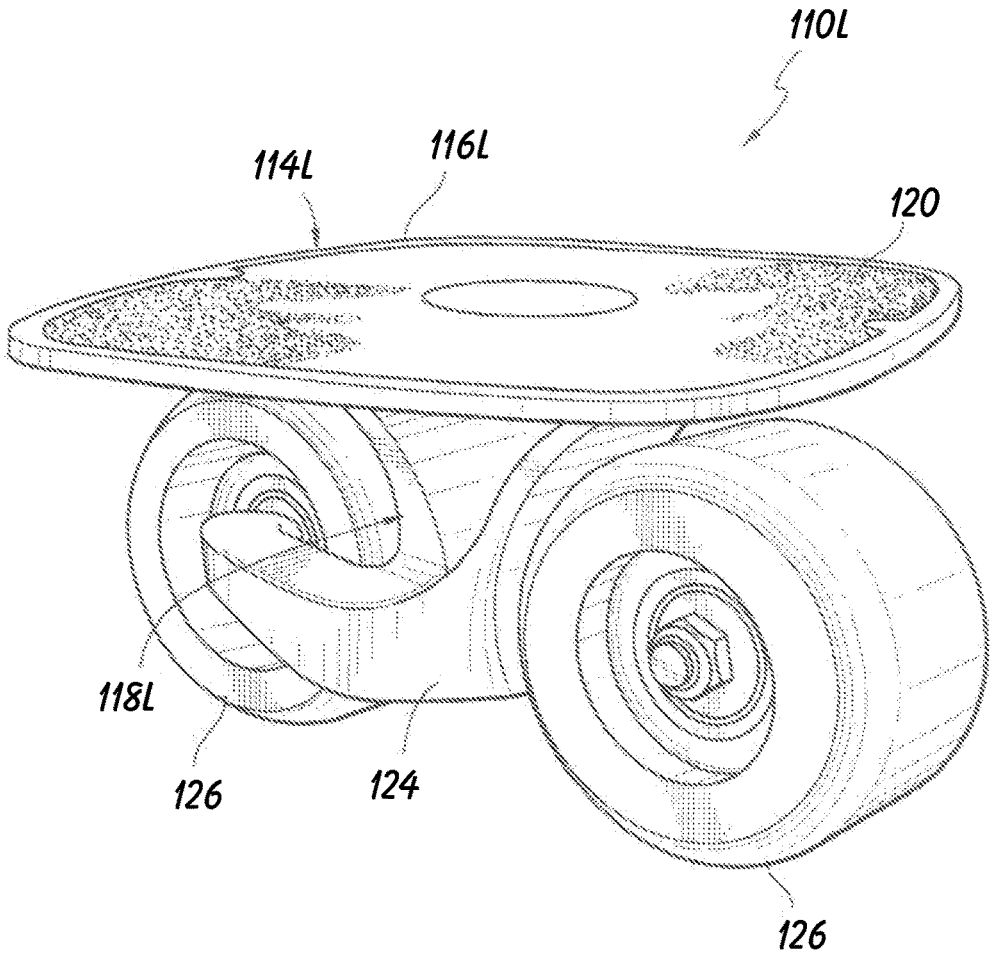
FIG. 2 PRIOR ART
FIG. 2 is a perspective view of a second embodiment of the Ferrelly transportation device.
Figure 3:
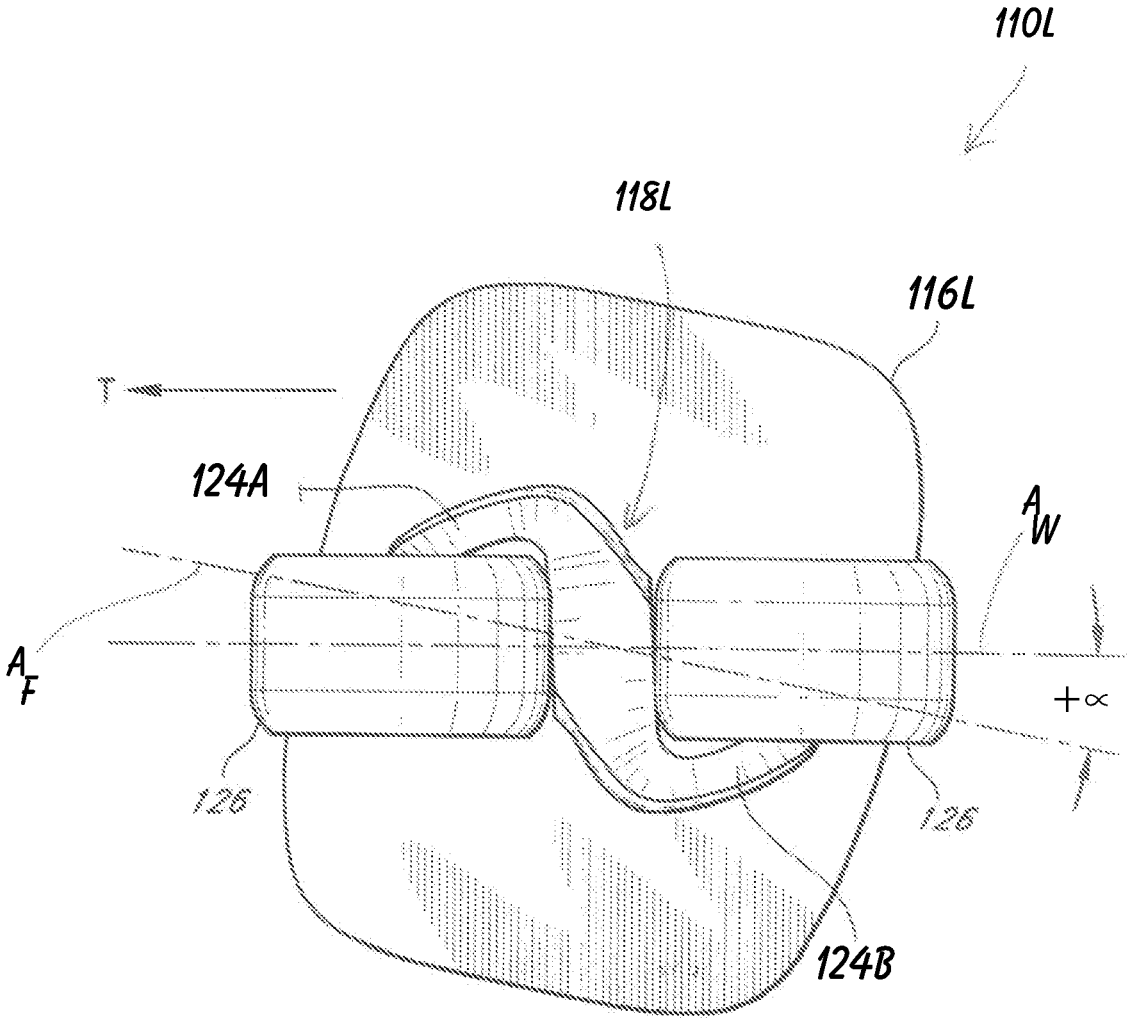
FIG. 3 PRIOR ART
FIG. 3 is a bottom view of the transportation device of FIG. 2.
Figure 4:
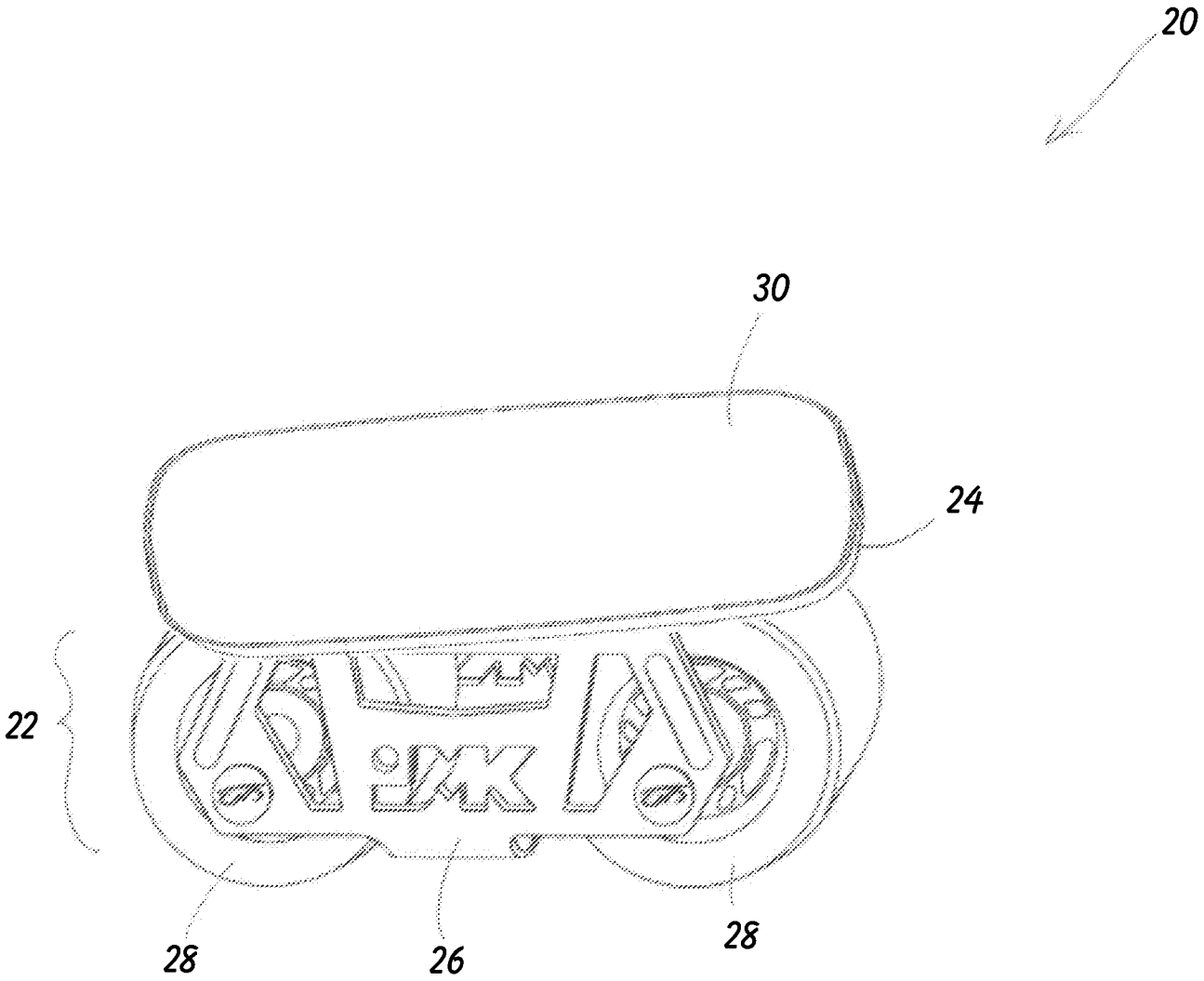
FIG. 4 is a perspective view of a preferred embodiment of the single-foot skateboard assembly of the present invention.

The present invention can best be understood by initial consideration of FIG. 4.[1] FIG. 4 is a perspective view of a preferred embodiment of the single-foot skateboard assembly 20 of the present invention. While this assembly 20 functions the same as the Ferrelly device in many ways, there are a few structural distinctions that have been demonstrated to provide substantial improvement and benefits as compared to that prior device.

[1] As used throughout this disclosure, element numbers enclosed in square brackets [ ] indicates that the referenced element is not shown in the instant drawing figure, but rather is displayed elsewhere in another drawing figure.

Figures 5A, 5B:
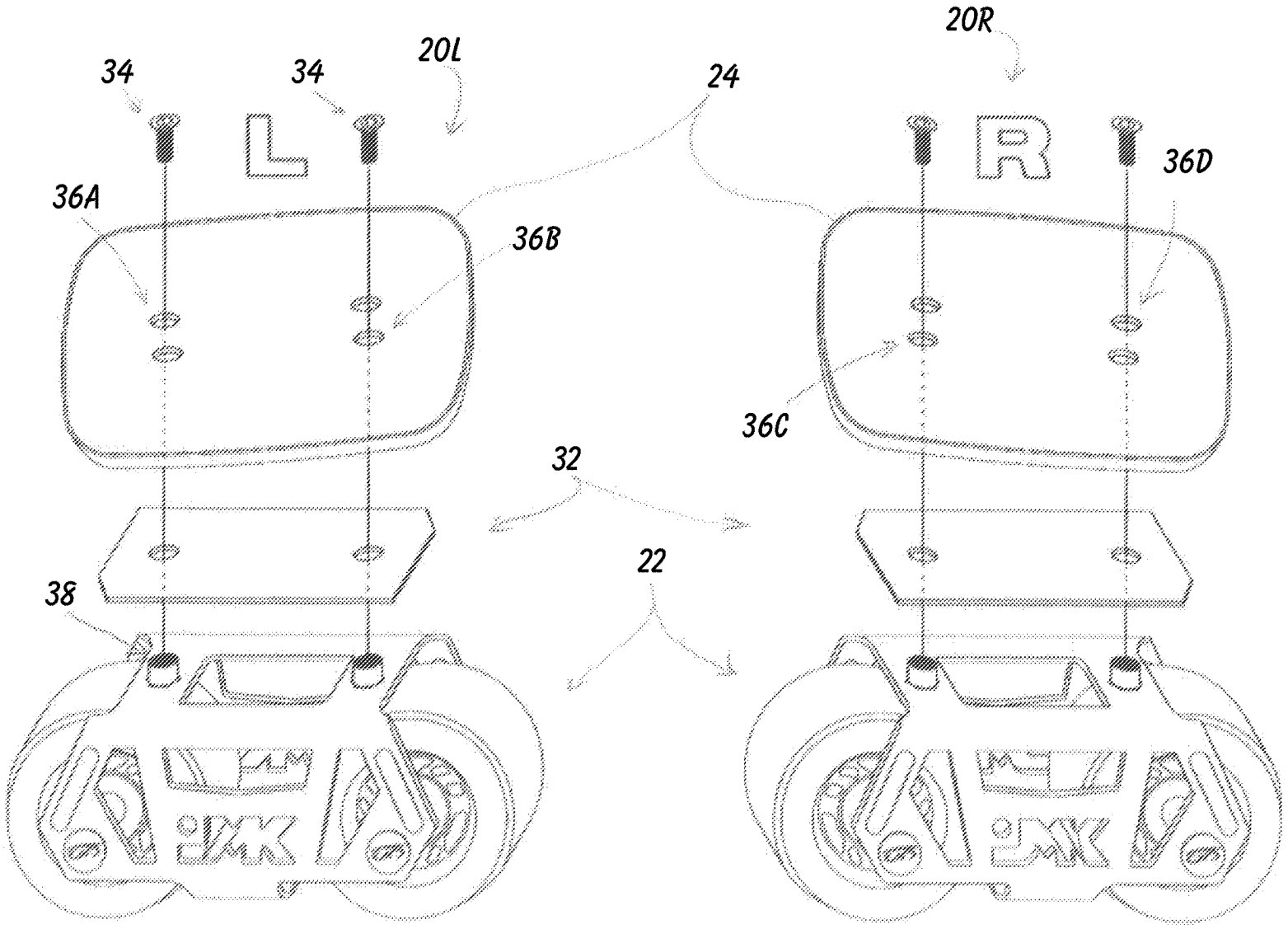
FIGS. 5A and 5B are partially exploded perspective views thereof.

The key distinction between the Ferrelly device and the instant design is that while the Ferrelly device [e.g. 110L] is specific to either a right or left foot, the components making up the assembly 20 can be used to create either a left- or right-foot skate. This is accomplished by pairing a reversible footboard 24 with a reversible truck assembly 22. The truck assembly 22 is composed of a frame 26 and a pair of wheel assemblies 28. The wheel assemblies 28 preferably have internal, built-in bearings in order to exhibit a sleeker appearance. The frame 26 is preferably formed from steel and then powder-coated in a variety of vibrant colors. The frame 26 and wheel assembly 28 combinations provide endless color options. The footboard 24 has a layer 30 of textured tape or film adhered to it. This layer 24 provides the user with a non-slip surface upon which to stand, while also hiding the mounting screws that hold the footboard 24 to the truck assembly 22. FIGS. 5A and 5B provide additional detail regarding these skates.

FIGS. 5A and 5B are partially exploded perspective views of left- and right-foot skate assemblies 20L, 20R of the present invention. The truck assemblies 22 for the two assemblies 20L, 20R are identical to one another (and therefore universal), and include a pair of threaded sockets 38 extending up from them. A cushioning pad 32 is optionally placed between the truck assemblies 22 and the footboards 24. This pad 32 is made from rubber, plastic or another sheet-type cushioning material that reduces the vibrations that pass from the road/sidewalk/etc. surface to the footboards 24. There are a pair of apertures formed in the cushioning pads 32 to accommodate the threaded sockets 38. As shown, two opposing corners of the pads 32 are cut off so that they will not stick out beyond the footboard 24 in the assembled skate assembly 20L, 20R.

The footboards 24 have a set of four apertures (36A, 36B, 36C and 36D) formed through them, although only two of them will be utilized at one time to mount to a truck assembly 22. The apertures for one skate assembly (20R or 20L) are paired diagonal from one another. For example, the first and second apertures 36A, 36B are utilized to assemble a left-footed skate assembly 20L. These apertures 36A and 36B are the upper left and the lower right holes formed through the footboard 24 of FIG. 5A. A flat-headed screw 34 is inserted through each aperture 36A, 36B, through the cushioning pad 32 of FIG. 5A and then to threadedly engage the threaded sockets 38 located in the truck assembly 22 of FIG. 5A. The user then places the textured layer [30] over the footboard 24 to protect the heads of the screws 34 and also to cover up the unused apertures (i.e. 36C and 36D are unused for skate assembly 20L).

It should be apparent that the relative angle between the footboard 24 and truck assembly 22 will change depending upon which set of apertures is used in the assembly of the skate assembly 20L/20R. We will examine that below in connection with FIGS. 7A and 7B after first looking at the bottom surface of the reversible footboards 24.

Figure 6:
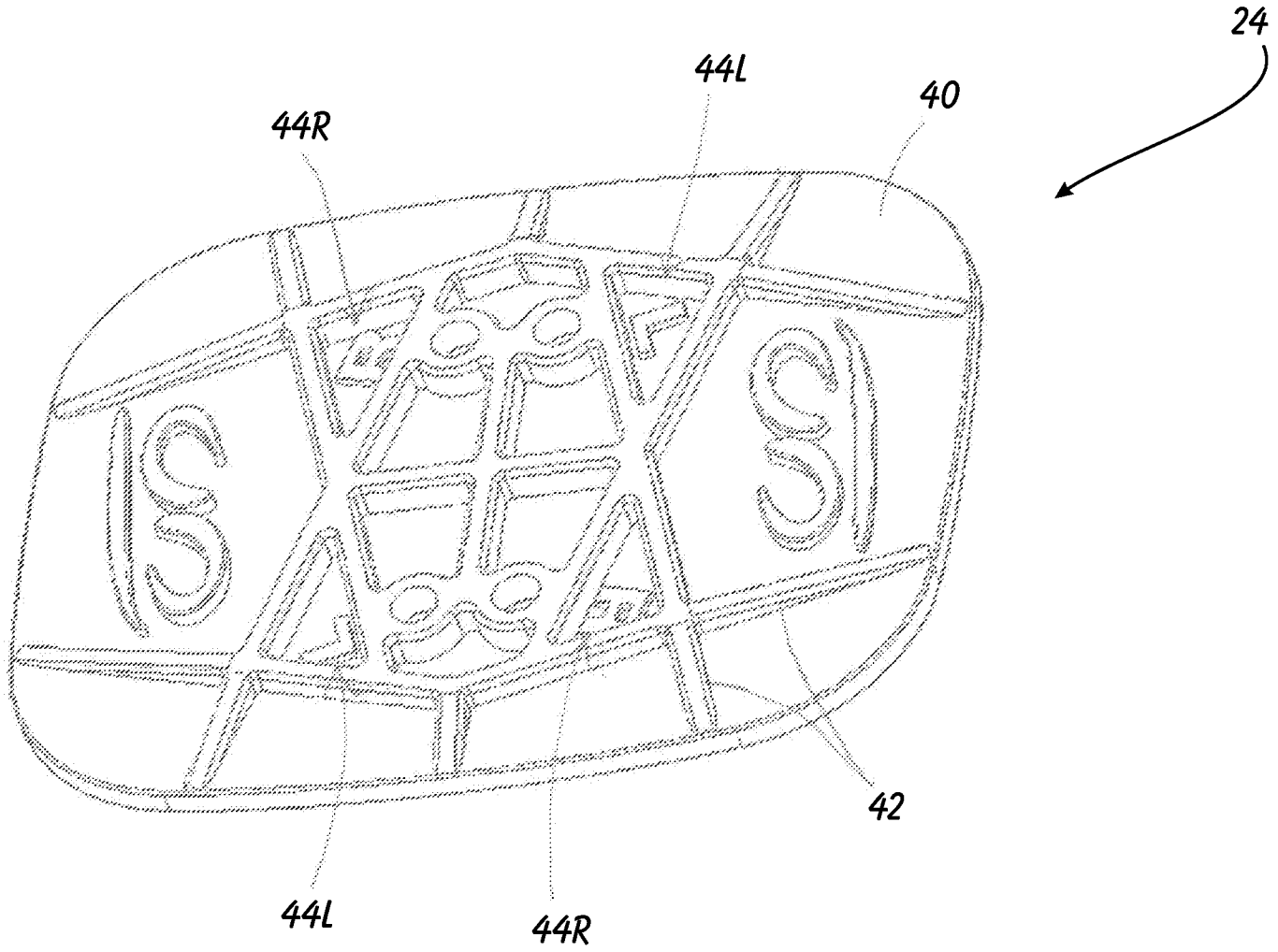
FIG. 6 is a perspective view of the footboard of the assembly of FIG. 4.

FIG. 6 is a perspective view of the footboard 24 of the assembly [20L or 20R] of FIG. 4. The bottom face of the reversible footboard 24 is preferably not smooth, but rather has a plurality of raised ribs 42 extending from the bottom surface 40. These ribs 42 provide structural strength—this allows the footboard 24 to be thinner and lighter weight than it would be without the ribs 42. These ribs and other raised features also provide additional grip to the user grasping the skate.

In the version shown, there are also indicia displayed on the bottom surface 40. One set of the indicia will be covered by the truck assembly [22] when it is mounted to the footboard 24—this will provide the user with a visual label to tell him or her whether the skate is for the left foot or for the right foot. For example, when the truck assembly [22] is attached to the footboard 24 to create a right-footed skate, the "R" indicia 44R will be exposed, and the "L" indicia 44L will be covered up by the frame [26]. These two versions are shown in FIGS. 7A and 7B.

Figures 7A, 7B:
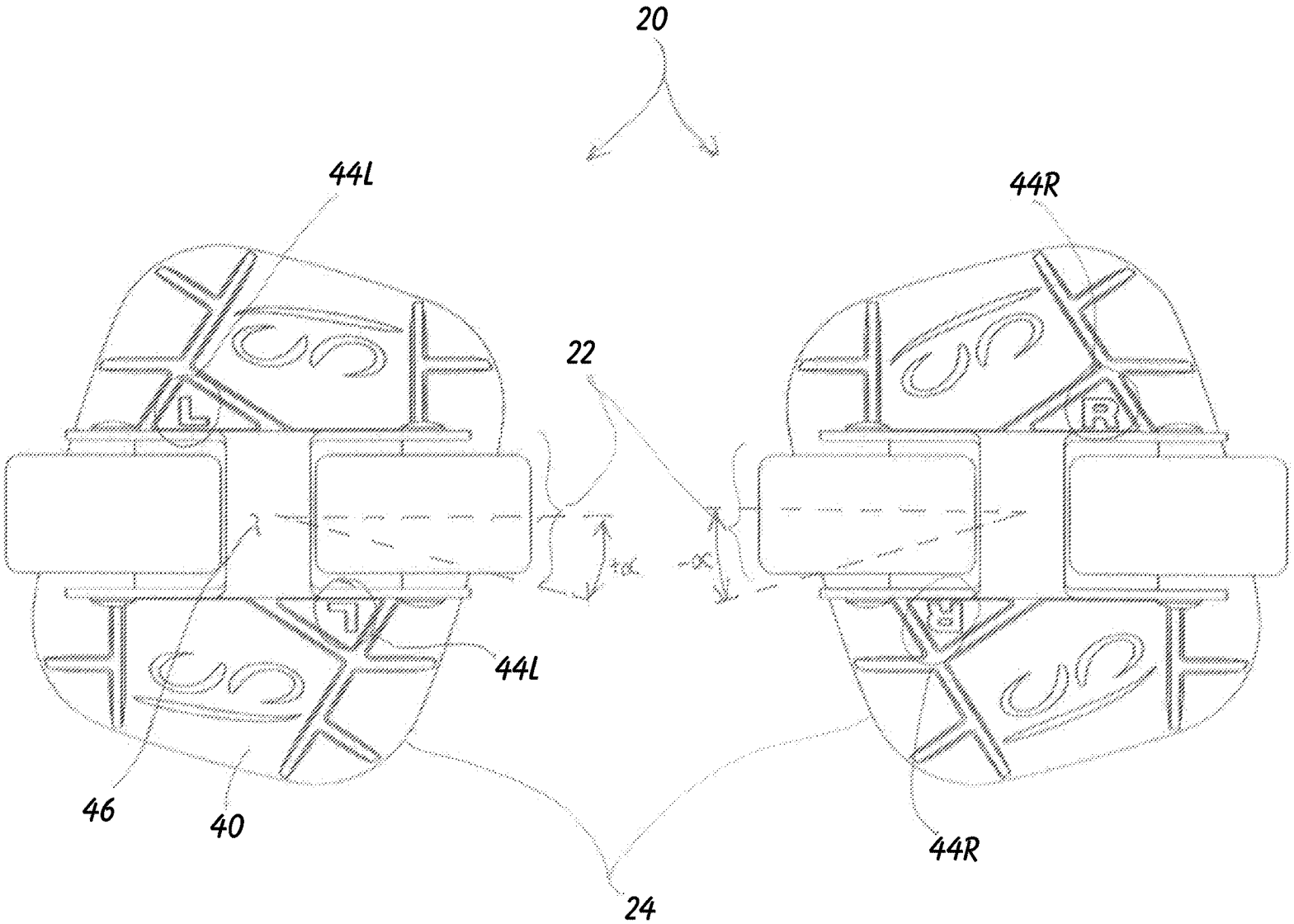
FIGS. 7A and 7B are bottom views of the assembly of FIG. 4.

FIGS. 7A and 7B are bottom views of the assembly 20 of FIG. 4. The skate 20 of FIG. 7A is assembled as a left-footed skate assembly [20L], and the skate 20 of FIG. 7B is assembled as a right-footed skate assembly [20R]. As shown, the indicia 44L and 44R on the bottom surface 40 of the footboards 24 are displayed for the respective skate assemblies 20.

In the assembly 20 of FIG. 7A the longitudinal axis of the wheels A(w) is offset from the axis of the footboard A(f) by offset angle +a. In the assembly 20 of FIG. 7B the longitudinal axis of the wheels A(w) is offset from the axis of the footboard A(f) by offset angle $-\alpha$. This is what makes the respective skate assemblies 20 perform as a right-footed or a left-footed skate assembly [20L or 20R].

Figure 8A:
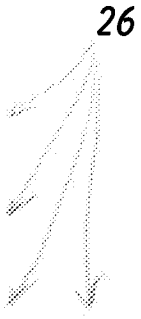
FIGS. 8A, 8B, 8C and 8D are right side, top, left side and end view of the frame of the assembly of FIG. 4.
Figure 8A:
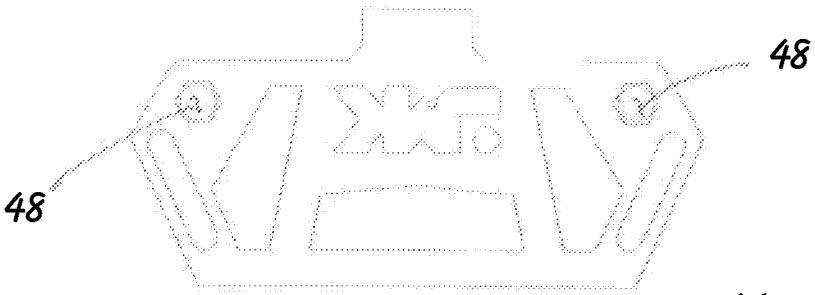
Figure 8B:
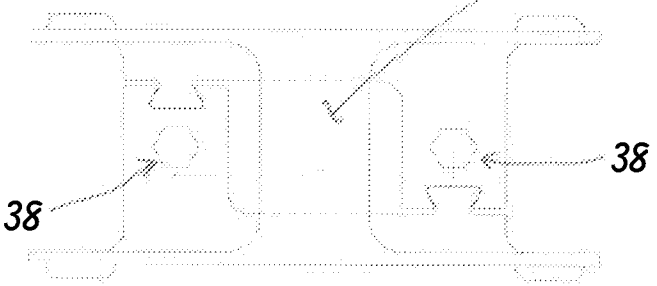
Figure 8C:
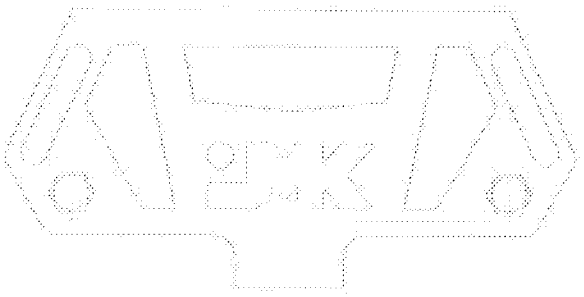
Figure 8D:
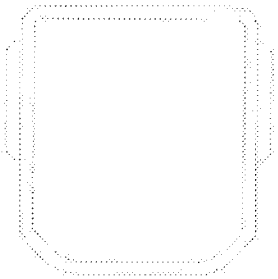

Another feature shown here is the grind plate 46 on the bottom-facing portion of the frame 26 separating the two wheels. These grind plates 46 create a low-friction surface for the rider to slide along coping, rails and the like (i.e. when performing tricks on the skates). This has been found to be vastly superior to sliding on the wheels. This grind plate 46 is shown in further detail below in FIGS. 8A and 8B, which are right and left side views of the frame 26. The wheel axle apertures 48 are also shown in these views. The threaded sockets 38 shown in the bottom view (FIG. 8B) shows the threaded sockets 38, which are generally flush with the top of the frames 26, rather than protruding upwardly as shown in FIGS. 5A and 5B. End view 8D shows that the frame 26 is generally square in cross-section.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A single-foot skate assembly, comprising:

a frame defined by a top, a bottom and two opposing ends;

a first wheel assembly rotatably attached to one said opposing end;

a second wheel assembly rotatably attached to a second said opposing end;

a deck element attachable to said top of said frame in either a first or second angular position relative to said frame:

wherein a truck assembly is defined by said frame and said first and second wheel assemblies, said frame further comprises a grind plate at said bottom between said first and second wheel assemblies, and said truck assembly further comprises two or more threaded sockets extending upwardly from said frame; and wherein said grind plate is a metallic element between said first and second wheel assemblies at a level such that it is non-parallel with the bottom surface defined by the wheels of said wheel assemblies.

2. The skate assembly of claim 1, wherein said deck element comprises two or more apertures formed therethrough and one or more screws passing through one said deck aperture to threadedly engage one said threaded socket.

3. The skate assembly of claim 2, further comprising a cushioning pad between said frame and said deck element.

4. The skate assembly of claim 1, wherein said deck comprises four said apertures formed therethrough, whereby said deck is attachable to said frame in said first angular position whereby two said screws pass through two of said apertures to threadedly engage both said threaded sockets, and said deck is attachable to said frame in said second angular position whereby two said screws pass through said other two of said apertures to threadedly engage both said threaded sockets.

5. A method for assembling a pair of single-foot skate assemblies, comprising the steps of:

obtaining a pair of truck assemblies, each said truck assembly comprising:

a frame having a pair of opposing ends with wheels rotatably attached thereto; and a pair of upwardly-extending threaded sockets;

obtaining a pair of deck elements, each said deck element defined by four apertures formed therethrough, said four apertures cooperatively formed such that pairs of diagonal said apertures align with said threaded sockets;

obtaining a pair of threaded screws configured to pass through said deck element apertures and into said threaded sockets;

assembling a left-foot skate assembly by aligning one diagonal pair of said deck apertures with said threaded sockets and attaching said deck element thereto with said pair of threaded screws; and assembling a right-foot skate assembly by aligning the other said diagonal pair of said deck apertures with said threaded sockets and attaching said deck element thereto with said pair of threaded screws.

6. The method of claim 5, wherein said right-foot skate assembly step is performed prior to said left-foot skate assembly step.

7. The method of claim 6, wherein said left-foot skate assembly step results in said deck element aligned at an offset of angle theta relative to said frame and said right-foot skate assembly step results in said deck element aligned at an offset of angle minus-theta relative to said frame.

8. The method of claim 5, wherein said left-foot skate assembly step results in said deck element aligned at an offset of angle theta relative to said frame and said right-foot skate assembly step results in said deck element aligned at an offset of angle minus-theta relative to said frame.

9. A reversible skate assembly, comprising:

a frame defined by a top, a bottom, two opposing ends, a longitudinal axis, and a pair of threaded sockets extending upwardly therefrom;

a first wheel assembly rotatably attached to one said opposing end;

a second wheel assembly rotatably attached to a second said opposing end;

a deck element defined by a deck longitudinal axis attachable to said top of said frame in either a first angular position whereby there is an angle theta between said deck element longitudinal axis and said frame longitudinal axis, or a second angular position whereby there is an angle of minus theta between said deck element longitudinal axis and said frame longitudinal axis, wherein said deck element comprises four apertures formed therethrough and one or more screws passing through one said deck aperture to threadedly engage one said threaded socket:

further comprising a resilient pad between said frame top and said deck element and a cushioning pad between said frame and said deck element: and further comprising a grind plate metallic element between said first and second wheel assemblies at a level such that it is non-parallel with the bottom surface defined by the wheels of said wheel assemblies.

* * * * *